US006499205B1

(12) United States Patent
Laffan

(10) Patent No.: US 6,499,205 B1
(45) Date of Patent: Dec. 31, 2002

(54) METHOD OF CONVERTING A CONTROL SET TO OBTAIN VARIOUS CONTROL PATTERN CONFIGURATIONS

(75) Inventor: Patrick W. Laffan, Raleigh, NC (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/677,300

(22) Filed: Sep. 29, 2000

(51) Int. Cl.[7] ..... G05G 1/24; G05G 1/28

(52) U.S. Cl. ..... 29/401.1; 74/471 XY; 74/491; 137/270; 137/636.2; 403/4

(58) Field of Search ..... 29/401.1; 74/471 XY, 74/491; 137/269, 270, 271, 636.2; 403/3, 4

(56) References Cited

U.S. PATENT DOCUMENTS 3,283,602 A * 11/1966 Lindell ..... 137/269
4,098,286 A * 7/1978 Prime ..... 137/270
4,134,560 A 1/1979 Messerschmidt
4,398,861 A 8/1983 Shimoie
4,646,778 A 3/1987 Tsuji et al.
4,736,647 A 4/1988 Shimoie et al.
5,125,232 A 6/1992 Arii
5,138,756 A * 8/1992 Johnson et al. ..... 137/289
5,232,057 A 8/1993 Renard
5,235,811 A 8/1993 Arii et al.
5,427,336 A 6/1995 Haggerty et al.
5,804,781 A 9/1998 Okabe

* cited by examiner

*Primary Examiner*—David Fenstermacher
(74) *Attorney, Agent, or Firm*—Diana L Charlton

(57) ABSTRACT

A method of converting a control set from an identifiable first control pattern configuration to an identifiable second control pattern configuration. The method provides a pair of control assemblies that may be easily rotated from a first position to a second position to accomplish the conversion. Each of the control assemblies include a respective control lever, rocker assembly, and linkage rods. After rotation of the control assemblies, the control levers are interchanged and connected to the opposite control assembly to establish an ergonomic position for the control levers. The method of converting the control set is completed without the need for additional components or complex modifications.

20 Claims, 5 Drawing Sheets

Y
X
X
Y
114
114
106
86
106
98
102
90
94
116
116
118
118
110
110
144
128
136
140
132
50
188
192
148
58
164
164
62
168
152
152
148
62
156
156
160
160
172
172
54
56
26
176
176
180
184
184
180

METHOD OF CONVERTING A CONTROL SET TO OBTAIN VARIOUS CONTROL PATTERN CONFIGURATIONS

This invention relates generally to a control set for operating a work machine, and more particularly, to a method of converting the control set to obtain two distinct control pattern configurations that are easily identifiable.

BACKGROUND ART

It is well known that a control set for operating a backhoe loader may be generally constructed for use in a variety of pattern configurations to operate various control valves via a control lever. Generally, the control set may be removed and modified in order to accommodate the preference of an operator who may be accustomed to a particular control pattern configuration. The removal and modification of the control set, however, may necessitate the use of complex or additional components that increase the cost and time necessary for the modification. Additionally, although some control sets may be easily modified into various control pattern configurations, such modifications are not within the manufacturer specifications and do not include identification of the modified control pattern configuration being utilized. Accordingly, it is desirable to provide a simple method of converting the control set so that additional or complex components are not required and the control pattern configuration being utilized may be easily identified.

A control structure is disclosed in U.S. Pat. No. 4,464,778 issued on Mar. 3, 1987 by Kazuhiko Tsuji and Youji Tsutsui. This patent utilizes a valve control structure for a working vehicle that operates two control valves by means of a control lever rockable crosswise. One of the valves is operable by a rocking movement in a first direction of the control lever and the other valve is operable by a rocking movement in a second direction of the control lever. A connection switching mechanism is provided between the control lever and the valves to switch interlocking relations of the two control valves with respect to the rocking directions of the control lever. The switching is readily carried out by operating a single switch lever to permit an operator to use the vehicle after selecting the preferred interlocking relations. In this patent, switching may be readily obtained; however, complex components must be included to provide the capability. Such components increase costs of the control set and the time needed for assembly.

Another such control structure is disclosed in U.S. Pat. No. 4,736,647 issued on Apr. 12, 1988 by Shizuo Shimoie, Kazuhiko Tsuji, and Masahiko Kobayashi. This patent utilizes a valve control structure for a working vehicle that comprises a control lever rockable crosswise, a first input rod pushed and pulled by rocking movements in a first direction of the control lever, a second input rod pushed and pulled by rocking movements in a second direction of the control lever, a first output rod connected to a first valve, a second output rod connected to a second valve, and an interlock switching device including bellcranks provided between the input rods and the output rods. The interlock switching device is operable to switch interlocking relationship between the input and output rods through the bellcranks. In one interlocking relationship, the first valve is controlled by rocking movements in the first direction of the control lever. In the other interlocking relationship, the second valve is controlled by the rocking movements in the first direction of the control lever and the first valve by the rocking movements in the second direction of the control lever. In this patent, the addition of the necessary components (such as the bellcranks) increases the complexity of the control set with cooperative switching mechanisms. Also, manufacturing costs and the time necessary for assembly of the control structure is increased. Further, the control set relates to the operation of different valves without changing their functionality.

The present invention is directed to overcoming the problems as set forth above.

DISCLOSURE OF THE INVENTION

In one aspect of the present invention, a method of converting a control set from a first control pattern configuration to a second control pattern configuration is disclosed. The method of converting the control set comprises the steps of providing a pair of spaced control levers with each of the control levers having a mounting plate connected thereto. Next, connecting each of the mounting plates to a bracket that has spaced first and second tab portions. Then, connecting a pair of linkage rods at a first end portion to the respective first and second tab portions of each of the brackets and connecting the pair of linkage rods at a second end portion to a respective pair of control valves. Next, connecting a rocker joint to each of the pair of brackets to define a pair of control assemblies with the respective control levers and linkage rods. Then, connecting each of the control assemblies to a base plate at a first predetermined position to define the first control pattern configuration wherein movement of either of the control levers about the respective rocker joint actuates the control valves in a predetermined manner via the pair of linkage rods. Next, substantially disconnecting each of the control assemblies from the base plate. Then, reconnecting the control assemblies at a second predetermined position angled from the first predetermine position to define the second control pattern configuration wherein movement of either of the control levers about the respective rocker joints actuates the control valves in a predetermined manner different from the predetermined manner of the first control pattern configuration. Finally, identifying whether the first control assembly is in either of the first or second control pattern configurations.

In another aspect of the present invention, a method of converting a control set from a first control pattern configuration to a second control pattern configuration is disclosed. The method of converting the control set comprises the steps of providing a first control assembly for actuating a first control valve. Connecting the first control assembly at a first predetermined location on a mounting member to establish a first predetermined position of the first control assembly that defines the first control pattern configuration. Movement of the first control assembly actuates the first control valve in a predetermined manner. Substantially disconnecting the first control assembly from the mounting member. Reconnecting the first control assembly to the mounting member at a second predetermined location to establish a second predetermined position of the first control assembly that defines the second control pattern configuration. Movement of the first control assembly actuates the first control valve in a predetermined manner different from the predetermined manner of the first control pattern configuration. Limiting connection of the first control assembly to either of the first or second locations on the mounting member.

The present invention is able to easily convert a control set from a first control pattern configuration to a second control pattern configuration without the need for additional components or complex modification.

BEST MODE FOR CARRYING OUT THE INVENTION

Figure 1:
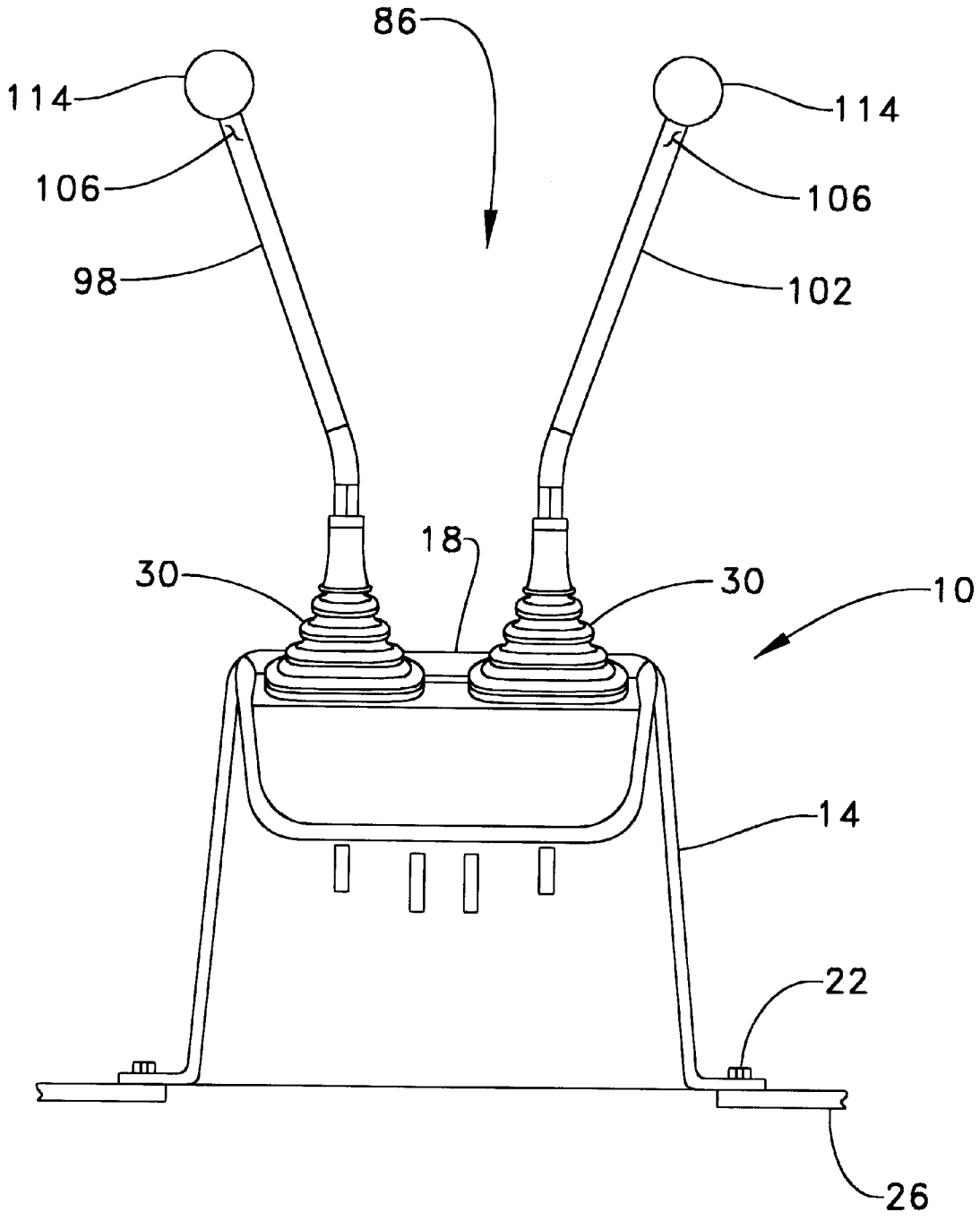
FIG. 1 is a front view of a control set as mounted on a floor of a work machine.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring to FIG. 1, a rear control console 10 includes a protective housing 14 with an upper portion 18 that defines a pair of openings therethrough (not shown). The housing 14 is mounted via a plurality of bolts, one of which is shown at 22, to the floor 26 of a work machine, such as a backhoe loader (not shown) having conventional boom and stick configuration (not shown). The work machine (not shown) may incorporate an attachment, such as a bucket or the like (not shown). A protective boot 30 is mounted substantially coaxially with each of the openings through the housing 14 via a mounting plate (not shown) connected to the housing 14. The control console 10 also includes a mounting assembly 50 located internally within the housing 14. The mounting assembly 50, seen clearly in FIGS. 2–5, has a bottom plate 54 connected to the floor 26 via a plurality of bolts 56, a base plate 58 located opposite the bottom plate 54, and a pair of spaced side plates 62. The base plate 58 defines a pair of spaced bolting patterns 66 with each bolting pattern 66 consisting of three openings 70,74,78 therethrough, seen more clearly in FIGS. 3 & 5.

Figure 2:
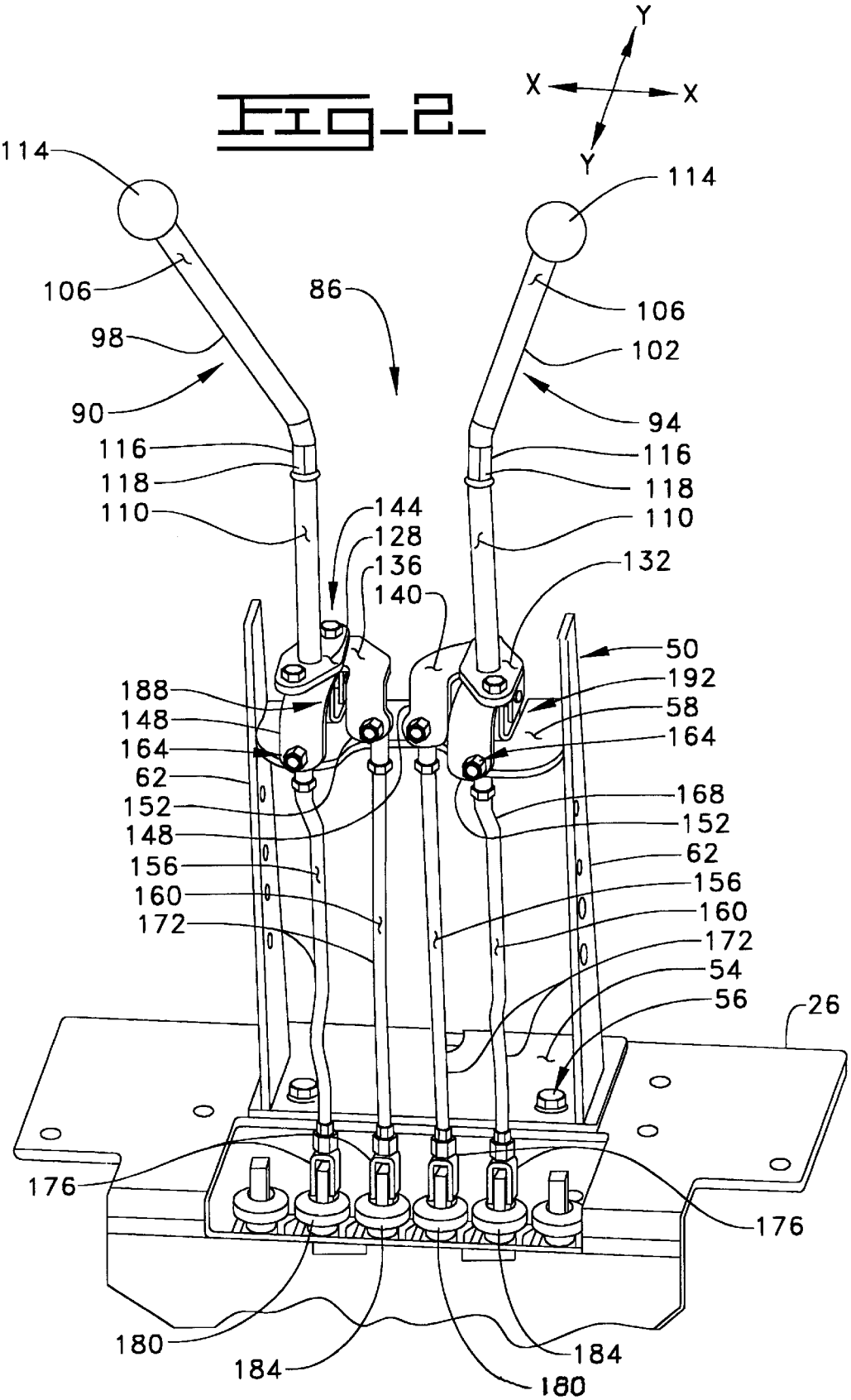
FIG. 2 is a fragmentary perspective view of the control set with portions removed to illustrate the internal components of the control set in a first control pattern configuration.
Figure 3:
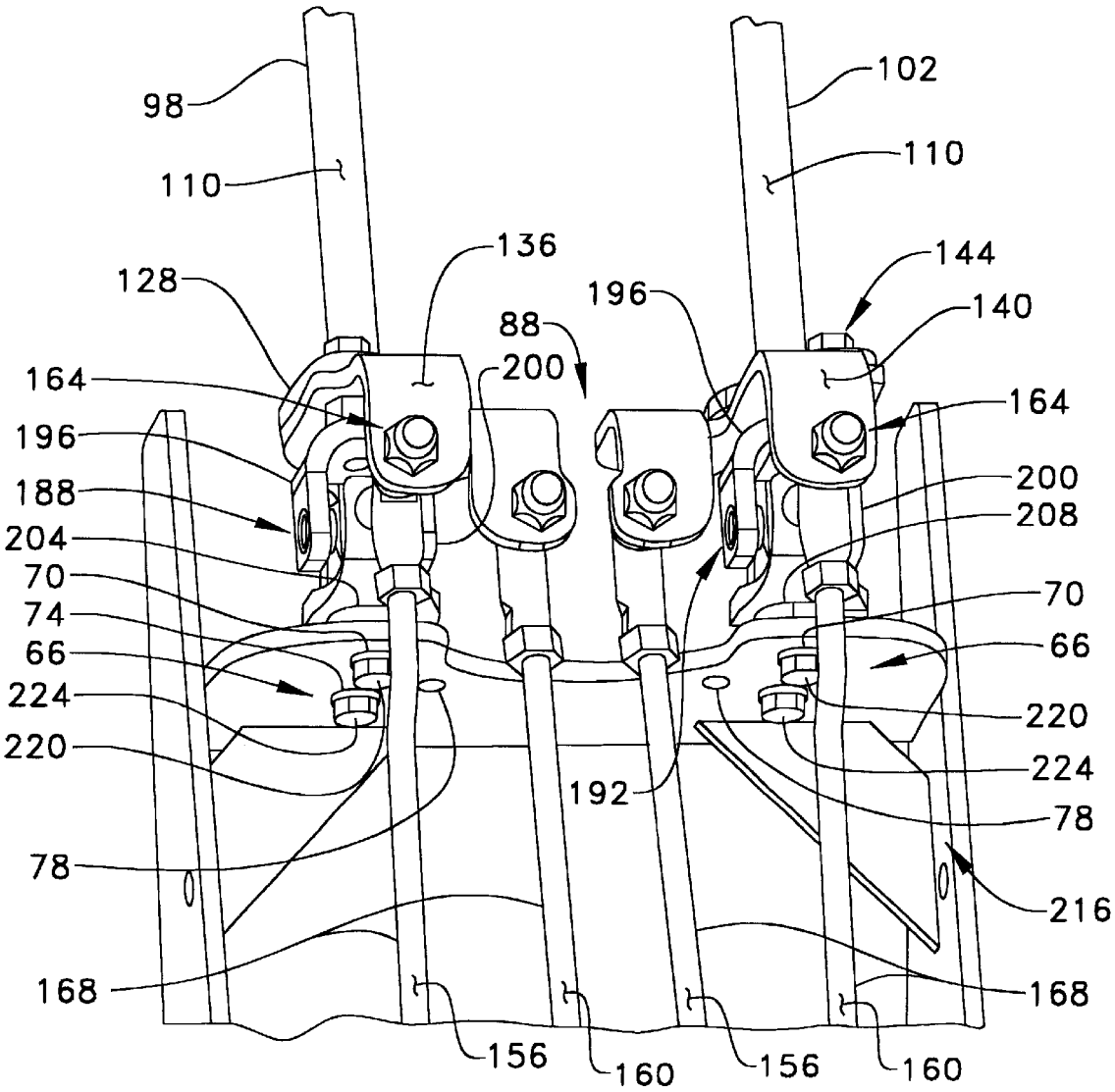
FIG. 3 is an perspective bottom view of the control set to illustrate the mounting position at the first control pattern configuration.

A control set 86 is shown in a first control pattern configuration 88 in FIGS. 1–3 and includes a pair of control assemblies 90,94. Each of the control assemblies 90,94 includes a control lever 98,102, respectively, that extend through the housing 14 and respective boot 30 (seen in FIG. 1). The control levers 98,102 have first and second end portions 106,110. The first end portion 106 is located externally from the housing 14 and the second end portion 110 is located internally within the housing 14. A control knob 114 is connected in any suitable manner at the first end portions 106 of each of the control levers 98,102. A film 116 is attached at a central portion of each of the control levers 98,102 and includes an "|" indicator 118 and an "X" indicator 122 (seen in FIG. 4). The "X" indicator 122 is located approximately 90 degrees from the "|" indicator 118. A mounting plate 128,132 is connected in any suitable manner at the second end portions 110 of each of the control levers 98,102 and is parallel with the base plate 58. Each of the mounting plates 128,132 are connected to a bracket 136,140, respectively, via a plurality of bolts 144 so that the film 116 is visible to an operator (not shown) of the control levers 98,102. Each of the brackets 136,140 have spaced first and second tab portions 148,152. A pair of linkage rods 156,160 are connected by bolts 164 at a first end portion 168 to the respective first and second tab portions 148,152 of each of the brackets 136,140 and are connected at a second end portion 172 by conventional yokes 176 to a respective pair of control valves 180,184. A pair of rocker assemblies 188,192 are connected in any suitable manner to the respective pair of brackets 136,140. The rocker assemblies 188,192 each include a conventional pair of U-shaped plates 196, 200, seen best in FIG. 3, that define a standard universal joint incorporating a needle bearing (not shown) or other suitable mechanism therebetween that allows the rocking motion of the control levers 98,102 in an X—X or Y—Y direction (denoted in both FIGS. 2 & 4). Each of the rocker assemblies 188,192 includes a connecting plate 204,208 mounted in any suitable manner to one of the pair of U-shaped plates 200. Each of the connecting plates 204,208 are mounted to the base plate 58 at a first position 216 via a pair of bolts 220,224 extending through two of the three openings 70,74, respectively.

Figure 4:
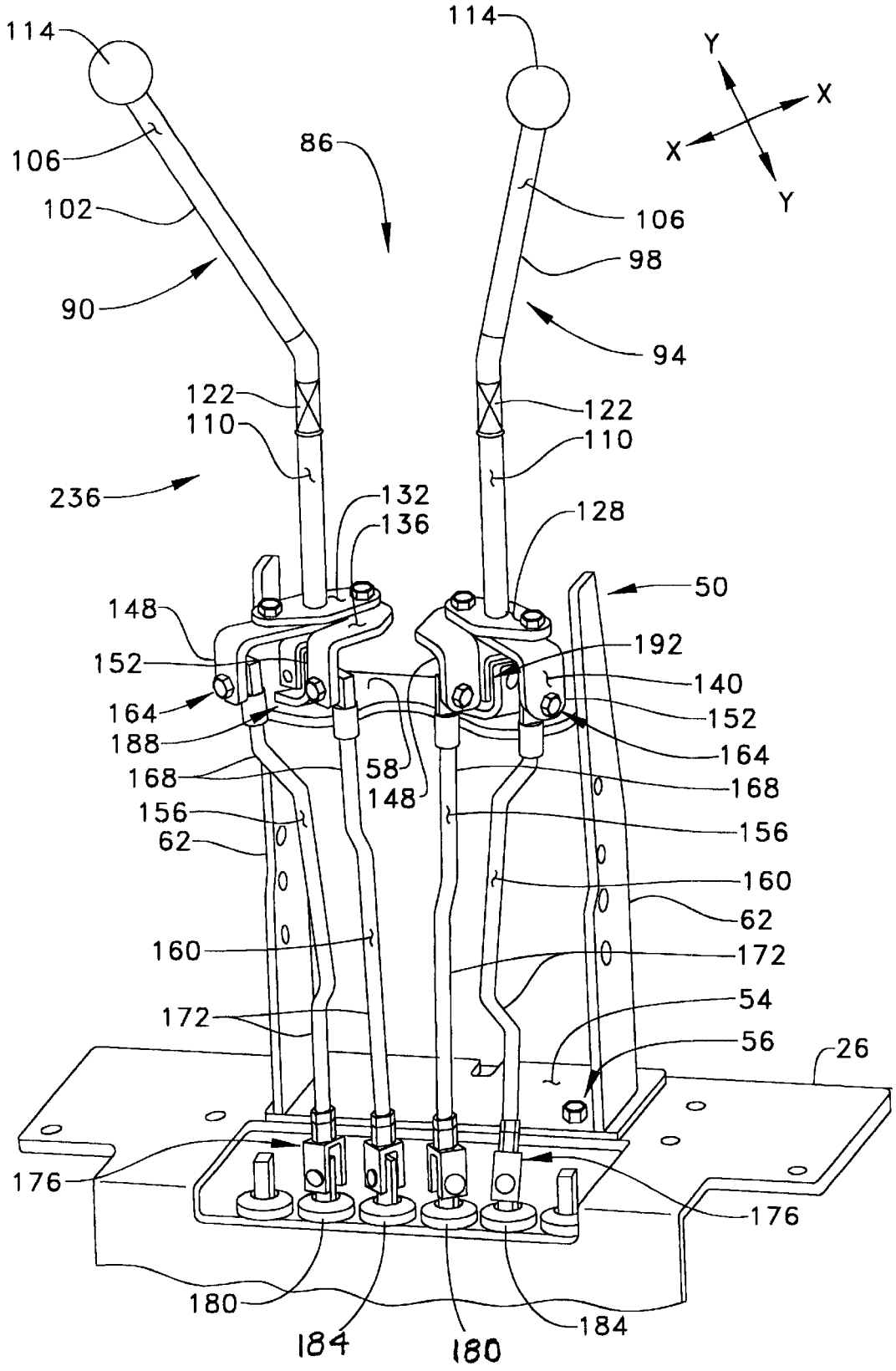
FIG. 4 is a fragmentary perspective view of the control set with portions removed to illustrate the internal components of the control set in a second control pattern configuration.
Figure 5:
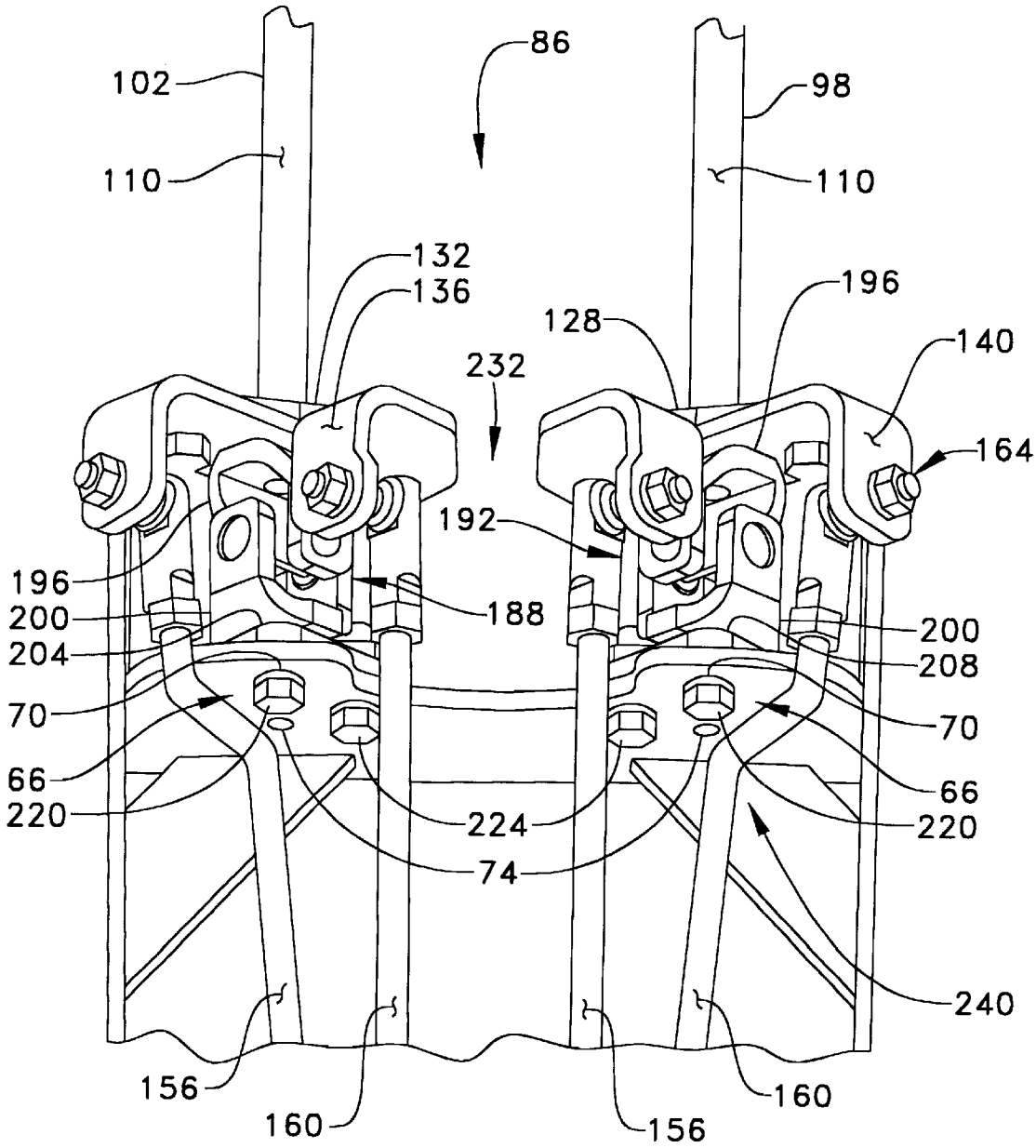
FIG. 5 is a perspective bottom view of the control set to illustrate the mounting position at the second control pattern configuration.

Referring to FIGS. 4–5, the control set 86 is shown in a second control pattern configuration 232 defined by a method 236 of converting from the first control pattern configuration 88 (described in more detail below). It should be understood that the elements shown in FIGS. 4–5 that are identical to the elements in FIGS. 1–3 will have the same reference numbers as those designated in FIGS. 1–3. In the second control pattern configuration 232, the connecting plates 204,208 of the control assemblies 90,94 are repositioned on the base plate 58 at a second position 240 angled approximately 45 degrees from the first position 216 via the pair of bolts 220,224 extending through the other two of the three openings 70,78, respectively. The control levers 98,102 are interchanged so that the mounting plates 128,132 are connected to the brackets 140,136, respectively, so that the film 122 is visible to the operator (not shown) of the control levers 98,102.

INDUSTRIAL APPLICABILITY

While in the first control pattern configuration 88, the control set 86 functions in a "standard" backhoe pattern wherein the movement of the boom (not shown) is controlled by moving the control lever 98 in the Y—Y direction (forward/aft). The swing of the boom (not shown) is controlled by moving the control lever 98 in the X—X direction (left/right). The movement of the stick (not shown) is controlled by moving the control lever 102 in the Y—Y direction (forward/aft). The bucket (not shown) is controlled by moving the control lever 102 in the X—X direction (left/right). The operator (not shown) is able to identify that the control set 86 is in the first control pattern configuration 88 by viewing the "|" indicator 118 on film 116.

The method 236 of converting the control set 86 from the first control pattern configuration 88 to the second control pattern configuration 232 includes loosening the bolt 220 within opening 70 in the base plate 58 and disconnecting the bolt 224 from opening 74 in the base plate 58. The control assemblies 90,94 may then be rotated from the first position 216 to the second position 240. The control assemblies 90,94 are mounted in the second position 240 by tightening the bolt 220 and reconnecting bolt 224 through opening 78 in the base plate 58. In order to gain substantial ergonomic advantage for the operator (not shown), the control levers 98,102 are disconnected from the respective control assembly 90,94 by disconnecting bolts 144 and reconnected to the opposite control assembly 90,94 by reconnecting bolts 144 after the control assemblies 90,94 are rotated. To maintain the parallel relationship between the mounting plates 128, 132 and the base plate 58, the length of the linkage rods 156,160 is adjusted for each control assembly 90,94 via bolts 164 until the second end portion 110 of the control levers 98,102 are vertically aligned with the base plate (below the bend in the control levers 98,102). Also, yokes 176 are rotated to allow the linkage rods 156,160 to articulate freely.

While in the second control pattern configuration 232, the control set 86 functions in a "cross" backhoe pattern wherein the movement of the boom (not shown) is controlled by moving the control lever 102 in the X—X direction (forward-right/aft-left). The swing of the boom (not shown) is controlled by moving the control lever 102 in the Y—Y direction (forward-left/aft-right). The forward and aft movement of the stick (not shown) is controlled by moving the control lever 98 in the Y—Y direction (forward-left/aft-right. The bucket (not shown) is controlled by moving the control lever 98 in the X—X direction (forward-right/aft-left). The operator (not shown) is able to identify that the control set 86 is in the first control pattern configuration 88 by viewing the "X" indicator 122 on film 116.

It should be understood that no additional or complex components are needed to convert the control set 86 from the first control pattern configuration 88 to the second control pattern configuration 232. Therefore, assembly of the control set is simplified and time for modification is reduced. It also should be understood that the method 236 of converting the control set 86 includes conversion from the second pattern configuration 232 to the first pattern configuration 88 and is within the scope of the present invention. Further, it should be understood that the connection of the components in the control assemblies 90,94 ensures that the control set 86 can be modified to operate only in the first or the second control pattern configurations 88,232.

Other aspects, objects and advantages of this invention can be obtained from a study of the drawings, disclosure and the appended claims.

What is claimed is:

1. A method of converting a control set from a first control pattern configuration to a second control pattern configuration, the method of converting the control set comprising the steps of:

providing a first control lever;

connecting a first linkage assembly with the first control lever to define a first control assembly for actuating a first control valve;

connecting the first control assembly to a mounting member at a first predetermined position to define the first control pattern configuration wherein movement of the first control lever actuates the first control valve in a predetermined manner;

substantially disconnecting the first control assembly from the mounting member;

reconnecting the first control assembly to the mounting member at a second predetermined position to define the second control pattern configuration wherein movement of the first control lever actuates the first control valve in a predetermined manner different from the predetermined manner of the first control pattern configuration; and identifying whether the first control assembly is in either of the first or second control pattern configurations.

2. The method of converting the control set of claim 1, including the steps of:

connecting a mounting plate to the first control lever; and maintaining the mounting plate of the first control lever substantially parallel with a base plate of the mounting member when in either of the first or second control pattern configurations.

3. The method of converting the control set of claim 1, including the step of:

marking the first control lever in a specific manner.

4. The method of converting the control set of claim 1, including the steps of:

providing a second control lever;

connecting a second linkage assembly with the second control lever to define a second control assembly spaced from the first control assembly for actuating a second control valve;

connecting the second control assembly to the mounting member at a first predetermined position to define the first control pattern configuration with the first control assembly wherein movement of the first and second control levers actuates the first and second control valves in a predetermined manner;

substantially disconnecting the second control assembly from the mounting member; and reconnecting the second control assembly to the mounting member at a second predetermined position to define the second control pattern configuration with the first control assembly wherein movement of the first and second control levers actuates the first and second control valves in a predetermined manner different from the predetermined manner of the first control pattern configuration.

5. The method of converting the control set of claim 4, including the step of:

substantially disconnecting and reconnecting the first and second control assemblies simultaneously.

6. The method of converting the control set of claim 4, including the steps of:

disconnecting each of the first and second control levers from the respective control assembly; and reconnecting each of the first and second control levers on the respective opposite control assembly after the second control pattern configuration is achieved.

7. The method of converting the control set of claim 6, wherein the step of disconnecting and reconnecting each of the first and second control levers includes the step of:

manufacturing the first and second control levers in a manner to achieve ergonomic positioning thereof when in either of the first or second control pattern configurations.

8. The method of converting the control set of claim 4, including the step of:

identifying whether the first or second control assemblies are in either of the first or second control pattern configurations.

9. The method of converting the control set of claim 8, wherein the step of identifying the control pattern configuration includes the step of:

attaching a film on each of the first and second control levers that includes an indicator of the respective control pattern configuration being utilized.

10. The method of converting the control set of claim 4, wherein the step of connecting a linkage assembly includes the steps of:

incorporating a mounting plate on each of the first and second control levers;

connecting each of the mounting plates to a bracket having spaced first and second tab portions;

connecting a rocker joint between each of the pair of brackets and the base plate; and connecting a pair of linkage rods at a first end portion to the respective first and second tab portions of each of the brackets and connecting the linkage rods at a second end portion to the respective first and second control valves and a respective third and fourth control valve.

11. The method of converting the control set of claim 10, including the steps of:

maintaining the mounting plates of the first and second control levers substantially parallel with a base plate of the mounting member when in either of the first or second control pattern configurations.

12. The method of converting the control set of claim 11, wherein maintaining the mounting plates includes the steps of:

adjusting the length of the pair of linkage rods for each control assembly.

13. The method of converting the control set of claim 1, including the step of:

limiting movement of the first control assembly to either of the first or second control pattern configurations.

14. The method of converting the control set of claim 1, wherein the step of reconnecting the first control assembly includes the step of:

locating the second predetermined position of the first control assembly at an angle from the first predetermined position.

15. The method of converting the control set of claim 1, wherein the steps of substantially disconnecting and reconnecting the first control assembly includes the steps of:

loosening a first fastening device;

disconnecting a second fastening device from a first opening in the mounting member;

rotating the first control assembly about the first fastening device;

tightening the first fastening device; and reconnecting the second fastening device through a second opening in the mounting member.

16. The method of converting a control set from a first control pattern configuration to a second control pattern configuration, the method of converting the control set comprising the steps of:

providing a first control assembly for actuating a first control valve;

connecting the first control assembly at a first predetermined location on a mounting member to establish a first predetermined position of the first control assembly that defines the first control pattern configuration wherein movement of the first control assembly actuates the first control valve in a predetermined manner;

substantially disconnecting the first control assembly from the mounting member;

reconnecting the first control assembly to the mounting member at a second predetermined location to establish a second predetermined position of the first control assembly that defines the second control pattern configuration wherein movement of the first control assembly actuates the first control valve in a predetermined manner different from the predetermined manner of the first control pattern configuration; and limiting connection of the first control assembly to either of the first or second locations on the mounting member.

17. The method of converting a control set of claim 16, including the steps of:

providing a second control assembly for actuating a second control valve;

connecting the second control assembly at a first predetermined location on a mounting member to establish a first predetermined position of the second control assembly that defines the first control pattern configuration wherein movement of the second control assembly actuates the second control valve in a predetermined manner;

substantially disconnecting the second control assembly from the mounting member;

reconnecting the second control assembly to the mounting member at a second predetermined location to establish a second predetermined position of the second control assembly that defines the second control pattern configuration wherein movement of the second control assembly actuates the second control valve in a predetermined manner different from the predetermined manner of the first control pattern configuration; and limiting of connection of the second control assembly to either the first or second locations on the mounting member.

18. The method of converting the control set of claim 17, including the steps of:

providing first and second control levers within the respective first and second control assemblies;

disconnecting each of the first and second control levers from the respective control assembly; and reconnecting each of the first and second control levers on the respective opposite control assembly after the second control pattern configuration is achieved.

19. The method of converting the control set of claim 18, wherein the step of disconnecting and reconnecting each of first and second control levers includes the step of:

manufacturing the first and second control levers in a manner to achieve ergonomic positioning thereof when in either of the first or second control pattern configurations.

20. The method of converting the control set of claim 17, including the step of:

identifying whether the first and second control assemblies are in either of the first or second control pattern configurations.

* * * * *